United States Patent [19]

Bacon

[11] Patent Number: 4,849,587

[45] Date of Patent: Jul. 18, 1989

[54] PENDANT CONTROL BOX

[75] Inventor: Rémy Bacon, Dignac, France

[73] Assignee: La Telemecanique Electrique, Nanterre, France

[21] Appl. No.: 123,950

[22] Filed: Nov. 23, 1987

[30] Foreign Application Priority Data

Nov. 25, 1986 [FR] France ..... 86 16386

[51] Int. Cl.[4] ..... H01H 9/06

[52] U.S. Cl. ..... 200/61.85; 200/298

[58] Field of Search ..... 200/5 R, 61.85, 157, 200/302.1, 302.3, 329, 330, 331, 332, 333, 334, 335, 336, 337, 338, 339, 340, 4, 1 V, 153 T, 298

[56] References Cited

U.S. PATENT DOCUMENTS

| | | | |
|---|---|---|---|
| 2,511,618 | 6/1950 | Baur | 200/4 |
| 2,908,827 | 10/1959 | Hickman | 307/10 |
| 3,654,415 | 4/1972 | Hawkins et al. | 200/157 X |
| 3,931,486 | 1/1976 | Raetz | 200/157 |
| 4,361,739 | 11/1982 | Harata et al. | 200/16 C |

FOREIGN PATENT DOCUMENTS

| | | |
|---|---|---|
| 829005 | 1/1952 | Fed. Rep. of Germany . |
| 2848093 | 5/1979 | Fed. Rep. of Germany . |
| 2847281 | 5/1980 | Fed. Rep. of Germany . |
| 2408904 | 6/1979 | France . |
| 713383 | 8/1954 | United Kingdom . |

*Primary Examiner*—A. D. Pellinen
*Assistant Examiner*—Morris Ginsburg
*Attorney, Agent, or Firm*—Young & Thompson

[57] ABSTRACT

An actuator (26) operates tappets (24, 25) of two switches (21, 22) each controlling one of the directions of operation of the motor. The actuator (26) is guided in a lateral direction (WW') between two active positions in each of which it may then be depressed, causing one of its bosses (55, 56) to actuate the corresponding switch (21 or 22). Flexible lugs (34, 35) return the actuator (26) to an intermediate position in which depression is prevented by a fixed pin (52) cooperating with a projection (51) of the actuator (26). The control box facilitates changing from one direction of operation to the other while avoiding rapid switching, harmful to the motors.

39 Claims, 6 Drawing Sheets

PENDANT CONTROL BOX

The invention relates to a control box, in particular of the type having abody, provided with a handle at the bottom and suspended from a vertical cable to control electric motors operable in two directions. The box comprises two switches mounted in a housing and an actuator that may be actuated by the operator's thumb from outside the housing to activate one or other of the two switches as required, leaving the other in the resting position.

These boxes are used universally to carry out upwards or downwards control of moving parts or hooks belonging to such varied items of equipment as pulley blocks, travelling cranes, tipper buckets and in general all means used to lift loads of different kinds with the aid of electrical motors.

A control box in which two distinct push-buttons are connected to two switches respectively in superimposed fashion for example, is already known, e.g. from DE-A- No. 2 847 281; reciprocal interlocking devices may of course be placed either between the push-buttons or between the moving parts of the switches.

In these control boxes, the operator's thumb, particularly during a delicate manoeuvre, has to make frequent movements in order to move from one button to the other; in view of the distance between two adjacent buttons, repetition of these movements quickly gives rise to fatigue, its most serious manifestation being confusion of the functions of the two buttons. If the buttons were arranged side by side, than admittedly the thumb movements would be less constricting, but they would nonetheless remain substantial and in any event the benefit of intuitive control in the most frequent case of lifting and lowering would be lost.

In other control boxes where attempts have been made to reduce the movements of the finger performing the control action, whether thumb or index finger, and to render them intuitive whilst at the same time preventing the simultaneous actuation of two switches, a rocker actuator is used with a horizontal pivoting axis, see for example DE-A-No. 2 848 093. However, the distance between the two pressure zones of the single button is still relatively large. In addition, with this device, and also with that discussed previously, a lateral blow to the box can cause one or other of the two switches to operate.

Such blows can for example occur when the operator inadvertently lets go off the handle or when the control box is buffeted by the wind in the operator's absence.

The object of the invention is thus to offer a control box of the type indicated at the outset but in which the movements to be made by the operator's finger are substantially reduced and rendered more convenient.

The control box in accordance with the invention is characterized in that guiding means guide the actuator relative to the housing, on the one hand along a lateral direction between two active positions and on the other hand along a direction of depression in each active position against a resilient restoring means, the actuator being connected to pressing means positioned so as to be, in each active position of the actuator, opposite an actuating member of one of the switches, which can then be actuated by depressing the actuator, and offset with respect to an actuating member of the other switch.

The lateral movement required in order to pass from one active position to the other may be rendered very small, virtually as small as may be wished, bearing in mind that it must nonetheless in practice remain perceptible to the operator.

The movements of the operator's finger are thus very limited. In addition, these movements are made without need to move from one button to another or from one pressure zone to another on a rocker switch. Throughout a manoeuvre, the operator's finger resting permanently on the same button controls both switches.

Further features and advantages of the invention will be evident from the description that follows.

In the drawings appended which are given by way of an example and are non-restrictive;

Figure 8:
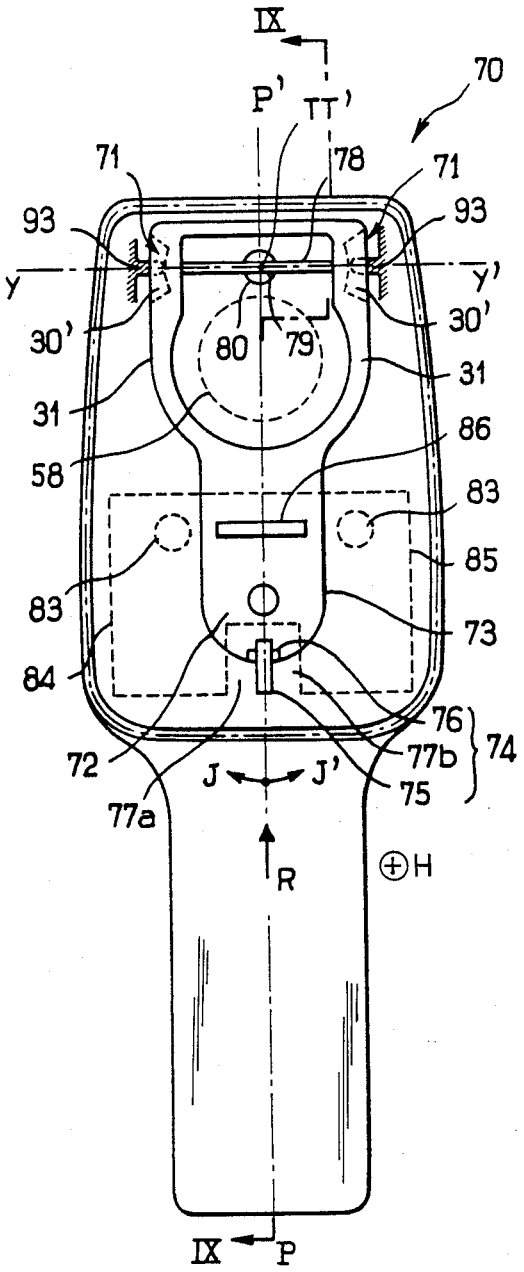
FIG. 8 is a view similar to FIG. 2 but relates to a second embodiment.
Figure 10:
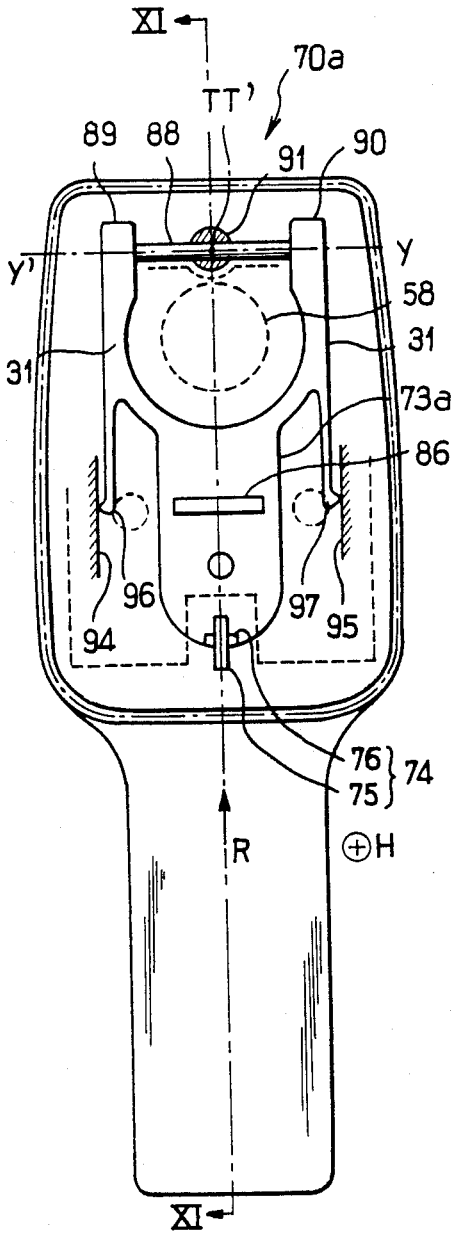
Figure 9:
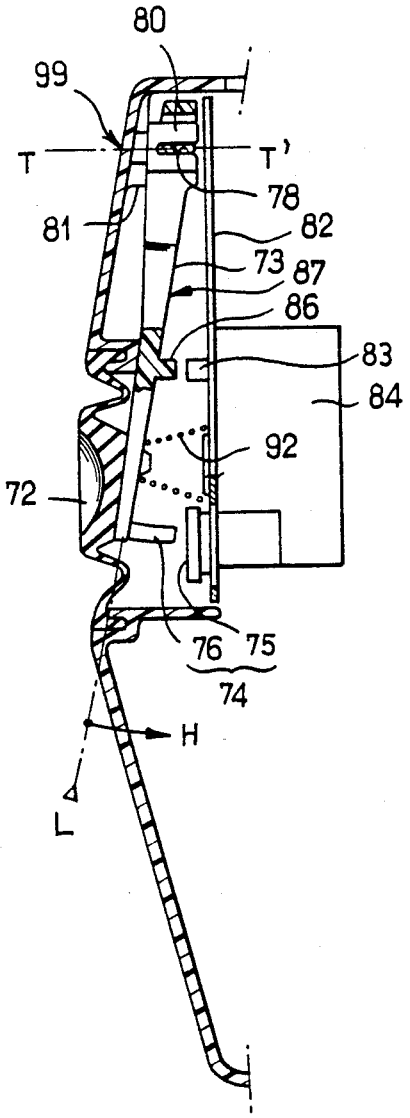
FIG. 9 is a view of the front part of the unit in FIG. 8, showing a section along line IX—IX of the latter.
Figure 11:
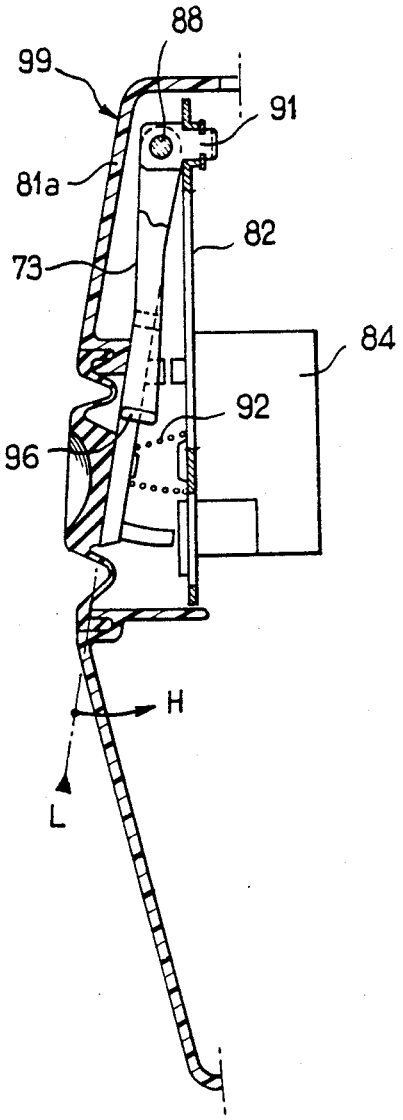
Figure 12:
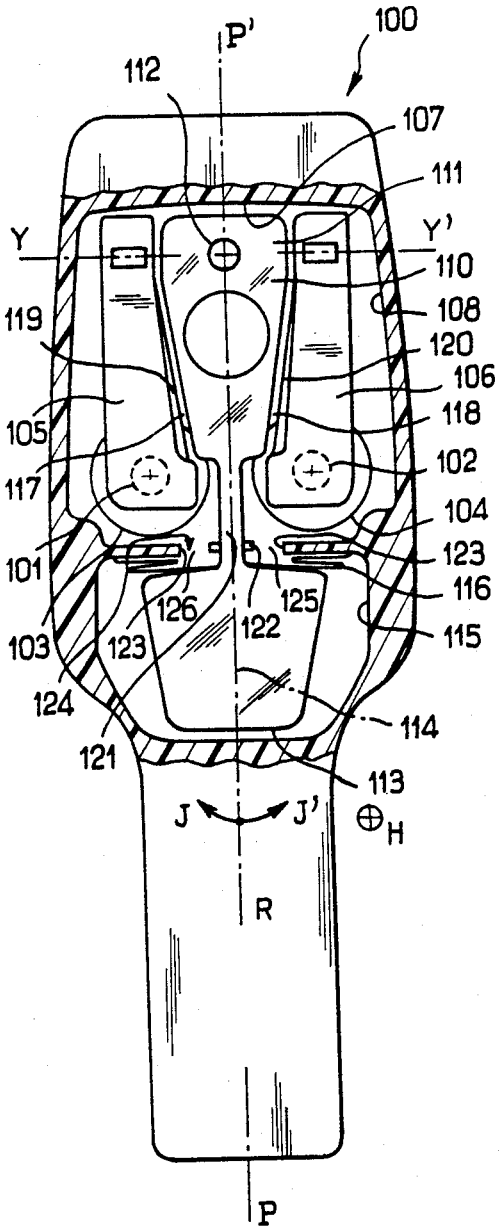
Figure 13:
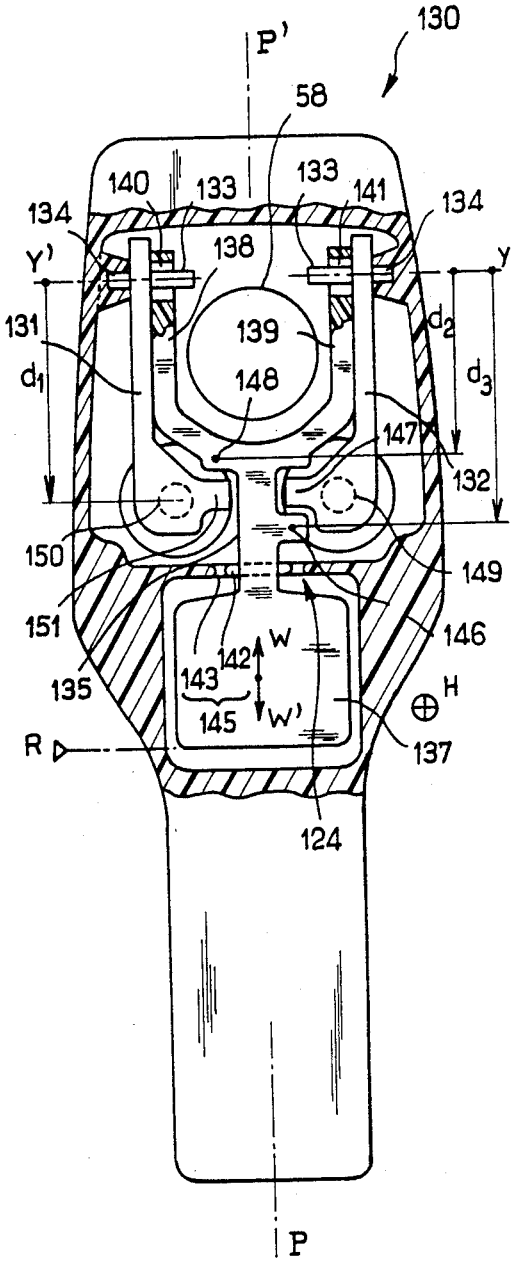

FIGS. 10 and 11 are views similar to FIGS. 8 and 9 respectively, but relating to a third embodiment of the invention; and FIGS. 12 and 13 are front views of a fourth and fifth embodiment of the invention respectively, the front housing being cut away.

Figure 1:
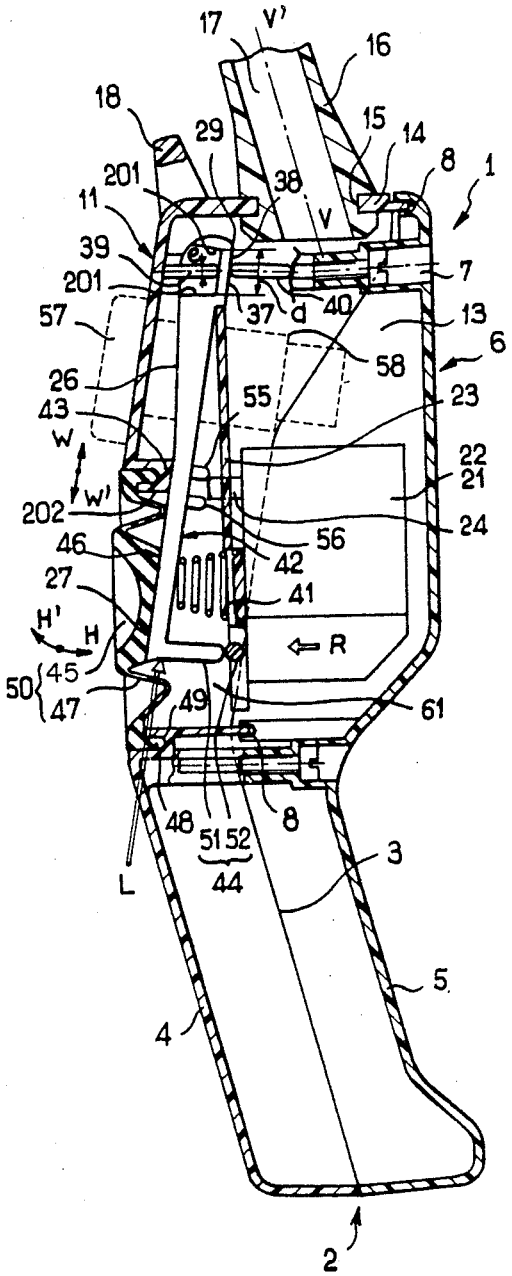
FIG. 1 is a view of a first embodiment of the invention generally showing a section along line I—I in FIG. 2, the slide not being cut.
Figure 3:
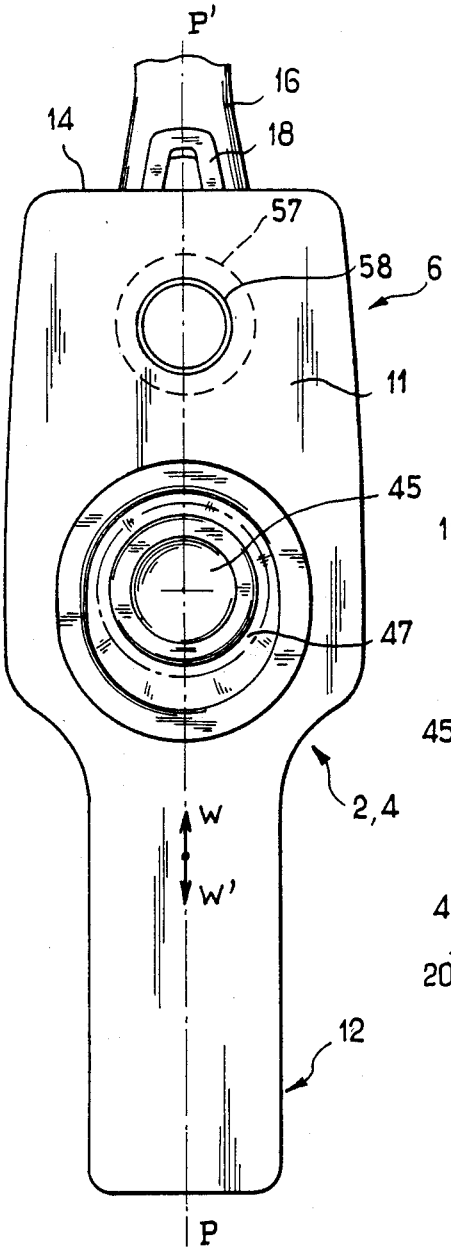
FIG. 3 is a front view of the device of FIGS. 1 and 2.

Control box 1 shown in FIG. 1 comprises a housing 2 consisting of two half-shells secured together along a common contour 3. One half-shell forms a front housing 4 having a front face 11 and the other a back cover 5. The housing 2 defines a body 6 and a bottom handle 12.

The half shells are assembled with the aid of screws 7 to form an annular baffle 8 around the body 6, possibly with a gasket (not shown) between them.

In the assembled state, the body 6 encloses a sealed cavity 13, a top wall 14 of which has an opening 15 therethrough suitable to receive an elastomer sleeve 16, the axis VV' of which is essentially vertical when an electric cable 17 passes therethrough for guiding its conductors into the cavity. The wall 14 has a suspension ring 18 on the outside, designed to take a fixing, which is not shown. The latter may consist of a loop on the end of a metal cable connected to the electronic cable.

The cavity, which should preferably be broader than the handle, contains two switches 21, 22 mounted side by side, to either side of a vertical median plane PP' of the unit, preferably on the rear face of a partition or plate 23. Each switch 21, 22 has a control push-button—or tappet—24, 25 which extends through plate 23. The tappets 24, 25 are movable in a direction transverse to the front face 11 and arranged in essentially symmetrical fashion in relation to the median plane PP' visible in FIG. 2.

An actuator or slide 26 arranged in the cavity 13 between the front face 11 and the plate 23 has a free end 27, in service pointing downwards, and remote from said end 27, two essentially parallel arms 31, 32 with ends 28, 29 each having a flexible articulated joint **30*a*, 30*b* around an axis YY' parallel to the front face 11** and horizontal when the control box is freely suspended from a vertical cable.

Stiffness of the slide 26 may be improved by a cross-piece 30 joining the ends 28, 29. The two parallel arms 31, 32, essentially symmetrical in relation to plane PP', form a clear space 33 between them, see FIG. 2.

Each of the ends 28, 29 has on its side facing away from the other arm, a narrower region—or rib—37 inserted in a space 38, between, adjacent one side of the slide, a fin 39 belonging to the front housing 4 and, adjacent the other side of the slide, an aligned fin 40 belonging to the cover 5. Each space 38, acting as an articulated joint, is situated in the axisYY', to enable the slide 26 to rotate about this axis. The edges of the fins 39 and 40 delimiting each space 38 are rounded (FIG. 1) to assist this rotation.

Each narrowed region 37 is limited at the top and bottom by shoulders 201 separated by a distance d greater than the thickness e of the fin between them.

With the slide 26 in a resting position R, the fin 39 is equidistant from the shoulders 201, such that the slide 26 may, in either direction from this resting position—R—by the rib 37 sliding between the fins 39 and 40, perform movements, essentially vertical in service, of a predetermined relatively small amount in direction W or W'. The direction parallel to the front face 11 corresponding to direction W or W' will henceforth be described as "lateral", as opposed to the direction of depression, H or H', followed by the end 27 of the slide 26 when the actuator is depressed or on the contrary released about the axis YY'.

Each end 28, 29 has two elastically flexible projections or shanks 34, 35, preferably integral with the slide. The shanks 34, 35 converge towards a neck of a common hook piece 36 located in plane PP' and which may belong either to the front housing 4 or to the plate 23.

The distance between the free ends of the shanks 34 and 35 is less than the corresponding dimension of the hook piece above and below the neck. Thus, upon rotation about axis YY', the shanks pivot in the neck, and upon movements W and W', the shanks bend elastically. In the resting position R, the shanks are essentially aligned along axis YY'.

A spring 41, in the example inserted between the plate 23 or the switches on the one hand and a face 42 of the slide on the other hand, permanently biases the slide in the direction H' contrary to the direction of depression towards the cavity In the preferred embodiment, this spring engages the free end 27 of the rocking slide 26 and restores it to a resting orientation—L—which may be defined by a stop 43 carried in the example by the front wall of the housing 2.

Movements in the lateral direction WW' and direction of depression HH' are communicated to the slide with the aid of a button 45 which is secured to the front face 46 of the end 27 of the slide.

This button is integral with a diaphragm 47 which surrounds it and the periphery of which 48 is substantially leak-tightly received in a slot 49 surrounding an opening 202 in the front face 11 of the body; ideally, the button and the diaphragm are part of one and the same elastomer moulding 50 which is flush with the front face 11. When the button 45 is depressed, the diaphragm 47 and the end 27 move in a space 61 which extends between the front face 11 and the plate towards the cavity 13.

To prevent the movement in the direction of depression H from being produced accidentally, locking means 44 prevent the slide 26 from being depressed when in position R, and thus compel the operator first to move the slide in direction W or W' from position R.

The locking means 44 in the example consist of a projection 51 which projects from face 42, essentially in plane PP', and a pin 52 arranged transversally in relation to this plane, opposite the projection ; this pin, which in service is stationary with the housing, may be embedded into the front housing 4 or held by switches 21, 22 or may belong to plate 23.

Thus any movement of the rocker slide in direction H must be preceded by a movement in direction W or W' to bring projection 51 to one side or the other of pin 52. The two movements can be carried out by the same thumb action by the operator on button 45.

In order to allow the movement H to be carried out along an adequate angular stroke, a space 53 locally separates the two switches to provide a passage for the projection 51.

The movement by which the button is depressed enables only one or other of the two tappets 24, 25 to be actuated depending on whether the slide has first been moved laterally upwards in direction W, or laterally downwards in direction W'.

To this end, face 42 of the slide has two bosses 55, 56 on either side of plane PP' , at different distances from axis YY'. Thus when the slide has been moved upwards (in direction W) see FIG. 5, boss 56 is level with the tappets, and when the slide is depressed in H, actuates the tappet 25 situated on the same side of plane PP' , whilst boss 55, offset with respect to tappet 24, leaves the latter in the resting position. When the slide has first been moved downwards (in direction W' ) see FIG. 7, for similar reasons, boss 55 actuates the tappet 24, whilst boss 56 leaves tappet 25 in the resting position.

A similar result can of course be obtained by placing the bosses at equal distance from axis YY' and the tappets at two different distances.

Thanks to the bifurcated configuration of the slide 26, it is possible to provide an auxiliary device on the front face 11 of the housing, such as an emergency stop switch or an indicator light 57, with the body 58 of said device being accomodated in cavity 13 between arms 31 and 32, where it is electrically connected.

In this embodiment, it will be noted that the front housing carries the main parts of the unit 1, and that it is sufficient to remove the cover 5, essentially performing a protective function, in order to gain access to the electrical terminals of the switches.

Figure 2:
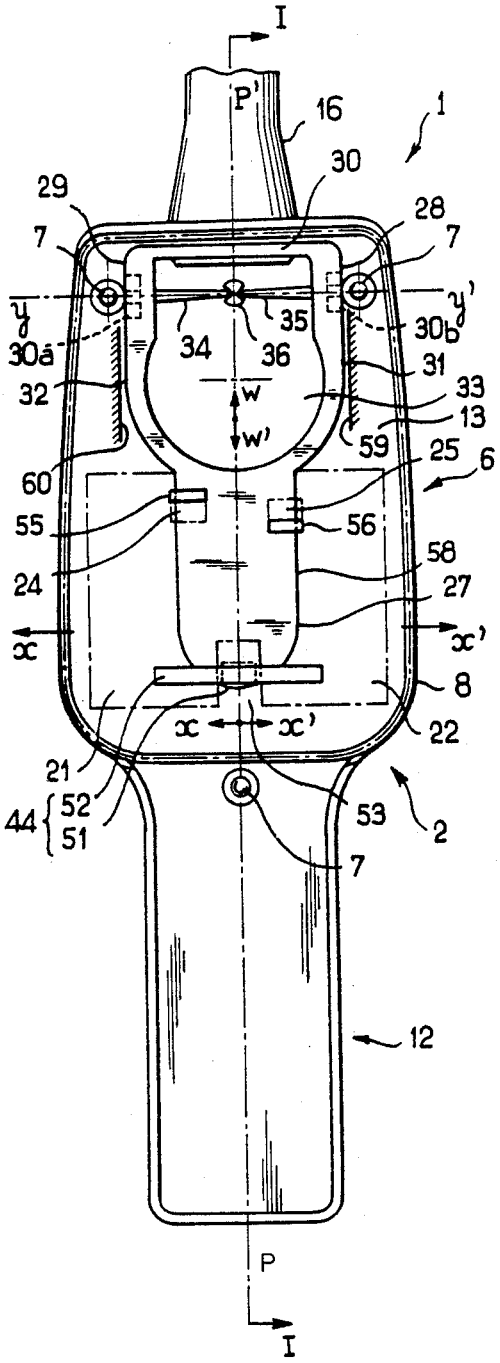
FIG. 2 is a view of the back of the unit, following removal of the cover and plate, the switches being shown as dashed and dotted lines.

If it is desired that no useless stress be communicated to the slide in direction X or X' transverse to plane PP', guiding surfaces as 59, 60, see FIG. 2, may be provided to either side of arms 31, 32 or to the central region 58 ; this transverse guiding is, furthermore, improved when the projection 51 penetrates space 53.

Figure 4:
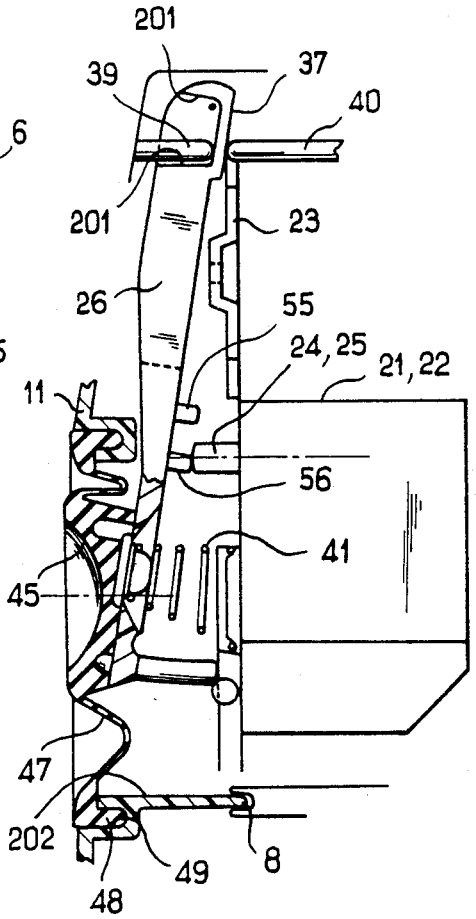
FIGS. 4 to 7 are similar views to FIG. 1, but partial and simplified, showing four operating stages.
Figure 7:
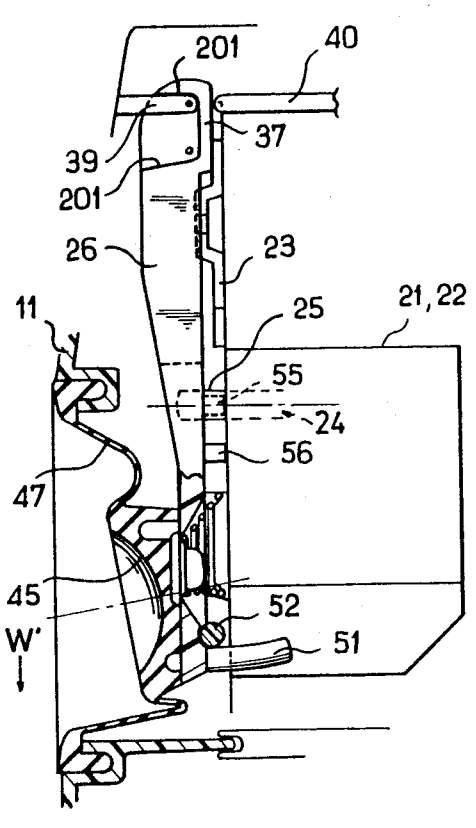
Figure 6:
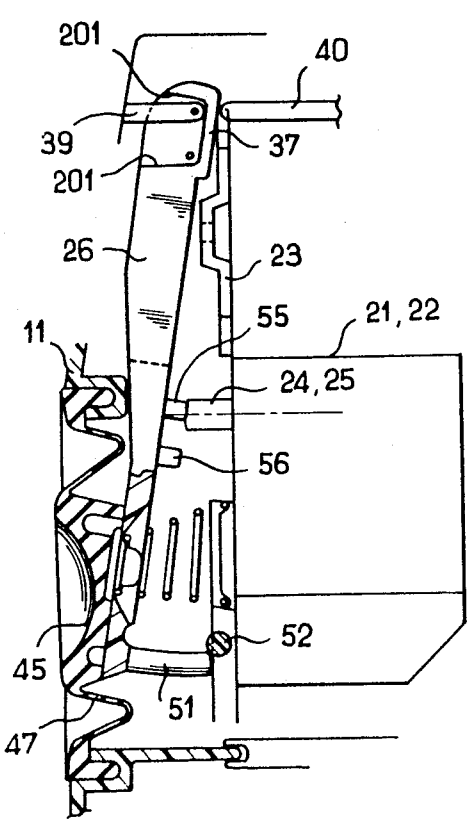
Figure 5:
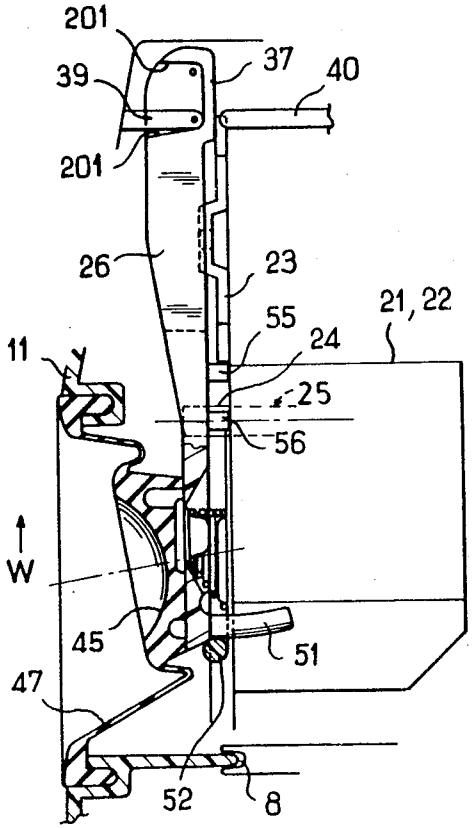

The various successive operating phases of the unit are visible on the one hand in FIGS. 4 and 5 where the slide is first moved in direction W and then in direction H, and on the other in FIGS. 6 and 7 where the slide is first moved in direction W' and then in direction H. The switch which is actuated when the slide is first moved upwards (direction W), controls for example the raising direction of a lifting device, and the other switch controls the lowering direction of the said device.

Reset to the longitudinal resting position and the resting orientation L is controlled by the resilient elements 34, 35 and 41 respectively.

It will be appreciated that a user using the control box just described for lifting or lowering a load will intuitively perform a relevant control of the actuator of said box, enabling him to concentrate his attention on the performance of other tasks.

In addition, the extent of movements in the direction W or W', that the operator's thumb is required to make is small in relation to the extent of the stroke that the latter can and must perform in order to cause actuation of the switches in direction H. Finally, the presence of the locking means 44, compelling the operator to release his pressure if he wishes to change the direction of movement of the load introduces into the change process a delay which is particularly beneficial to the motors.

The principle of selective orientation used to ensure mobility and locking of the slide of a unit such as 1, directed towards the performance of intuitive control of vertically moving parts or installations, may be extended to that of a unit such as 70 which is designed to generate control for parts or installations movable horizontally leftwards or rightwards.

In such a unit 70, as shown in FIGS. 8 and 9, which is described only insofar as it differs from the previous unit, articulated joints 71 allow the slide 73 to move in the direction HH' (pivoting around axis YY') and in a lateral direction JJ' across plane PP', essentially around an axis TT', essentially parallel to direction HH' and situated mid-way between the articulated joints. The guide surfaces 59, 60 of the earlier embodiment have been omitted.

A locking device 74 comprises a locking pin 75 carried by plate 82 opposite a projection 76 on the rear face of slide 73 when the latter occupies a resting position R between the two extreme slanting positions around axis TT'. When the slide is sufficiently slanted in direction J or J' parallel to the front face 99 from position R, it becomes possible for button 72 to be depressed, projection 76 moving into one or other of two spaces 77*a* and 77*b* between the pin 75 and each switch 84, 85.

Although the structure of FIGS. 8 and 9 as described hereinabove could be combined with the slide articulation and reset means which have been described by reference to FIGS. 1–6, there are shown in FIGS. 8 and 9 alternative articulation and reset means to be described hereinafter. These means consist of a thin crosspiece 78 which is resiliently deformable under twisting and bending and connects arms 31 of the slide along axis YY'. Mid-way between said arms 31, crosspiece 78 is embedded in a central slot 79 of an eye 80, axis TT', integral with front housing 81 or plate 82. Each arm 31, on its side remote from the other arm, has a recess 30' accomodating a projection 93 stationary with the housing. The recesses 30' are elongated in the circumferential direction around axis TT' and their base has a circular profile the axis of which is the axis TT'. Thus the slide is able to pivot about axis YY', which passes through the projections 93, whereby the crosspiece 78 is twisted either side of the eye 80, and to pivot about axis TT' by opposite movements of the recesses 30' along the projections 93, whereby the crosspiece 78 which is bent either side of the eye 80.

The crosspiece 78, acting as a torsion bar, biases the slide towards position L, and may be assisted therefore by a conical helicoidal compression spring 92 inserted between the slide and the plate.

Actuation of tappets 83 of the two switches 84, 85 placed side by side is achieved here by a single boss 86 carried on the rear face 87 of the slide. In position R, the boss 86 is not opposite any tappet. It moves opposite one or other of them depending on whether the slide is given a slant J or J'; the length of the boss measured parallel to YY' and the space between the tappets 83 are such that a single switch can be actuated when the button 72 is depressed.

As in the previous embodiment, small thumb movements enable one or other of the switches to be operated without risk of error, it being necessary to sufficiently split up the movement from one switch to the other.

In an embodiment shown in FIGS. 10 and 11, described only insofar as it differs from that in FIGS. 8 and 9, the crosspiece 88 is rigid and pivots about its axis YY' in the eye 91, itself pivoting about axis TT' in relation to the plate. The top crosspiece stiffening the slide is omitted. Each arm 31 is extended in the direction away from its end 89 or 90 by an elastic lug 96 or 97 resting against one of two facing walls 94 and 95 of the front housing or of the plate. Lugs 96 and 97 provide for return to position R. Spring 92 provides for return to position L.

In a different embodiment 100 of a unit liable to give the operator a sensation of intuitive right and left hand control shown in FIG. 12, the function of actuating the resiliently returned tappets 101, 102 of two switches 103, 104 mounted side by side is assigned to two parallel levers 105, 106 pivotally mounted about axis YY' in the upper region 107 of cavity 108, and extending to said tappets 101, 102.

The actuator here consists of a third lever 110, having an end 111 which, adjacent axis YY', is articulated to the housing by a ball joint 112, and an opposite end 113 extending through an opening 124 in the bottom wall of the cavity 108 and into a bottom space 115 where it carries a button 114. A diaphragm 116 seals the above opening around the lever.

Two lateral regions or ribs 117, 118 of lever 110, when said lever is in the resting position R, are located between two notches 119, 120 in levers 105 and 106, whilst an intermediate region 121 of the lever 110 faces a heel 122 of the plate : this heel, extending across plane PP', is separated from the side edges 123 of the opening 124 by two spaces 125, 126 having a width exceeding the width of the intermediate region 121 so as to receive said region 121 when the lever is inclined in direction J or J' and then depressed around the ball joint 112.

Such orientation also causes one of the ribs 117 or 118 to engage adjacent notch 119 or 120, and actuation of only one of the two levers 105, 106 and consequently of only one of the switches 103 or 104 is achieved when the button is depressed, in direction H.

In a different embodiment 130 shown in FIG. 13 and to be described only insofar as it differs from the embodiment of FIG. 12, the actuator here is a slide 135 having, at the end away from button 137, two arms 138, 139, each having an opening 140, 141 elongated parallel to the direction WW' and crossed by a pin 133, axis YY', which is carried by the adjacent actuating lever 131 or 132 and points towards the other lever, 132 or 131 respectively. Moreover, levers 131 and 132, on the side thereof facing away from the pins 133, carry pins 134, which are pivotally received along axis YY' in corresponding recesses connected to the housing. Thus the slide can, in relation to the housing and actuating levers 131 and 132, pivot about axis YY' and move in direction WW'.

Resilient means that are not shown bias the slide towards a resting position R from which the slide may be subjected to movements WW' in either direction with a stroke limited by the length of openings 140, 141.

In position R of the slide, a heel or stub 12 extends opposite a rear edge 143 of opening 124. Upon movements of the slide along direction W or W', the heel or stub 142 is offset with respect to edge 124.

The locking device 145 thus provided hence prevents button 137 from being depressed when in the resting position R. When the slide is moved in direction W, a lug 146 on the slide overlaps a lateral extension 147 of the lever 132, whilst in the opposite direction, a second portion 148 on the slide overlaps an extension 151 of lever 131. This arrangement can be obtained by giving to distances d3 and d2, (which separate 148 and 146 of axis YY' respectively) values being respectively more and less than distance d1 between the two tappets of switches 149, 150 and axis YY'.

In this embodiment, as indeed in those in FIGS. 1 to 11, space is available for the auxiliary device 58 between the arms, such as 138, 139 of the slide.

I claim;

1. A control box, adapted to be suspended from a depending cable, to control an electric motor with two directions of operation, comprising:

two switches being each provided with an actuating member, said switches being mounted in a housing provided with a bottom handle which is stationary with respect to the housing;

an actuator mounted in the housing and adapted to be actuated by the thumb of an operator's hand gripping the bottom handle, means guiding the actuator in relation to the bottom handle, on the one hand for movement in a lateral direction between two active positions, and on the other for movement from each active position in a depression direction against an elastic reset device, and the actuator being connected to pressure means which are so positioned that in each active position of the actuator the pressure means face a respective said actuating member of one of the switches which can then be actuated by depressing the actuator, and are offset with respect to another said actuating member of the other switch, which remains unactuated upon said depression movement of the actuator.

2. A control box as set forth in claim 1, wherein between the two active positions, the actuator may take up an intermediate position in which actuation of the two switches is rendered impossible.

3. A control box as set forth in claim 2, wherein in the intermediate position, the pressure means are offset with respect to the two actuating members.

4. A control box as set forth in claim 2, wherein in the intermediate position, locking means prevent depression of the actuator.

5. A control box as set forth in claim 2, comprising means biasing the actuator towards its intermediate position.

6. A control box as set forth in claim 1, wherein the actuator is surrounded by a deformable sealing diaphragm, the periphery of which is sealingly connected to the periphery of an opening in the housing, through which opening an area of the actuator is accessible to the operator's thumb from the outside.

7. A control box as set forth in claim 6, wherein to the actuator is added a button with which the diaphragm is integral.

8. A control box as set forth in claim 1, wherein the pressure means comprise a respective individual pressure element for each switch.

9. A control box as set forth in claim 1, wherein for its movement in said lateral direction, the actuator is pivotally guided about an axis essentially parallel to the direction of depression.

10. A control box as set forth in claim 1, wherein for its movement in said lateral direction the actuator is guided in translation in that direction.

11. A control box as set forth in claim 1, wherein when depressed, the actuator is pivotally guided about an axis transverse to the direction of depression.

12. A control box as set forth in claim 11, wherein to enable movement in said lateral direction, the actuator is slidingly guided in the vicinity of said transverse axis.

13. A control box as set forth in claim 1, wherein the actuator is held in relation to the housing via sliding guides permitting, by sliding, movement in the lateral direction and by pivoting the movement of depression.

14. A control box as set forth in claim 1, wherein remote from one end accessible to the user's thumb, the actuator is bifurcated into two arms the ends of which are connected to the guiding means.

15. A control box as set forth in claim 14, wherein the arms are connected by flexible means to a hooking device mounted between them and, in service, stationary with the housing.

16. A control box as set forth in claim 14, wherein an auxiliary device is fixed in a wall of the housing in such a way as to occupy a space between the arms inside the housing.

17. A control box as set forth in claim 1, wherein the two switches are arranged side by side on either side of a median plane of the housing, the said median plane being essentially parallel to the lateral direction of movement of the actuator.

18. A control box as set forth in claim 1, wherein the pressure means comprise at least one boss of the actuator.

19. A control box as set forth in claim 1, comprising for each switch a lever actuated by the pressure means when the actuator is depressed into the corresponding active position.

20. A control box adapted to be suspended from a vertical cable and provided with a bottom handle, said control box being adapted to control an electric motor operable in two directions, comprising two switches mounted in a housing and an actuator which may be actuated by the operator's thumb from the outside of the housing, to activate one of the two switches as selected, and to leave the other in a rest condition, wherein guiding means guide the actuator in relation to the housing, on the one hand along a lateral direction between two active positions, and on the other hand along a direction of depression in each active position, against resilient restoring means, the actuator being connected to pressure means positioned so as to be in each active position of the actuator, opposite an actuating member of one of the switches which can then be actuated by depressing the actuator, and offset with respect to an actuating member of the other switch, and wherein between the two active positions, the actuator may take up an intermediate position in which the pressure means are offset with respect to the two actuating members and actuation of the two switches is rendered impossible.

21. A control box as set forth in claim 20, wherein, in the intermediate position, locking means prevent depression of the actuator.

22. A control box as set forth in claim 20, comprising means biasing the actuator towards its intermediate position.

23. A control box as set forth in claim 20, wherein the pressure means comprise a respective individual pressure element for each switch.

24. A control box adapted to be suspended from a vertical cable and provided with a bottom handle, said control box being adapted to control an electric motor operable in two directions, comprising two switches mounted in a housing and an actuator which may be actuated by the operator's thumb from the outside of the housing, to activate one of the two switches as selected, and to leave the other in a rest condition, wherein guiding means guide the actuator in relation to the housing, on the one hand along a lateral direction between two active positions, and on the other hand along a direction of depression in each active position, against resilient restoring means, the actuator being connected to pressure means positioned so as to be in each active position of the actuator, opposite an actuating member of one of the switches which can then be actuated by depressing the actuator, and offset with respect to an actuating member of the other switch, and wherein between the two active positions, the actuator may take up an intermediate position in which actuation of the two switches is rendered impossible by locking means preventing depression of the actuator.

25. A control box as set forth in claim 24, comprising means biasing the actuator towards its intermediate position.

26. A control box as set forth in claim 24, wherein the pressure means comprise a respective individual pressure element for each switch.

27. A control box adapted to be suspended from a vertical cable and provided with a bottom handle, said control box being adapted to control an electric motor operable in two directions, comprising two switches mounted in a housing and an actuator which may be actuated by the operator's thumb from the outside of the housing, to activate one of the two switches as selected, and to leave the other in a rest condition, wherein guiding means guide the actuator in relation to the housing, on the one hand along a lateral direction between two active positions, and on the other hand along a direction of depression in each active position, against resilient restoring means, the actuator being connected to pressure means positioned so as to be in each active position of the actuator, opposite an actuating member of one of the switches which can then be actuated by depressing the actuator, and offset with respect to an actuating member of the other switch, the control box further comprising means biasing the actuator towards an intermediate position which is intermediate between the two active positions and in which actuation of the two switches is rendered impossible.

28. A control box as set forth in claim 27, wherein the pressure means comprise a respective individual pressure element for each switch.

29. A control box adapted to be suspended from a vertical cable and provided with a bottom handle, said control box being adapted to control an electric motor operable in two directions, comprising two switches mounted in a housing and an actuator which may be actuated by the operator's thumb from the outside of the housing, to activate one of the two switches as selected, and to leave the other in a rest condition, wherein guiding means guide the actuator in relation to the housing, on the one hand along a lateral direction between two active positions, and on the other hand along a direction of depression in each active position, against resilient restoring means, the actuator being connected to pressure means positioned so as to be in each active position of the actuator, opposite an actuating member of one of the switches which can then be actuated by depressing the actuator, and offset with respect to an actuating member of the other switch, and wherein the actuator is surrounded by a deformable sealing diaphragm, the periphery of which is sealingly connected to the periphery of an opening in the housing, through which opening an area of the actuator is accessible to the operator's thumb from the outside.

30. A control box as set forth in claim 29, wherein the actuator includes a button with which the diaphragm is integral.

31. A control box adapted to be suspended from a vertical cable and provided with a bottom handle, said control box being adapted to control an electric motor operable in two directions, comprising two switches mounted in a housing and an actuator which may be actuated by the operator's thumb from the outside of the housing, to activate one of the two switches as selected, and to leave the other in a rest condition, wherein guiding means guide the actuator in relation to the housing, on the one hand along a lateral direction between two active positions, and on the other hand along a direction of depression in each active position, against resilient restoring means, the actuator being connected to pressure means positioned so as to be in each active position of the actuator, opposite an actuating member of one of the switches which can then be actuated by depressing the actuator, and offset with respect to an actuating member of the other switch, and wherein the pressure means comprise a respective individual pressure element for each switch.

32. A control box adapted to be suspended from a vertical cable and provided with a bottom handle, said control box being adapted to control an electric motor operable in two directions, comprising two switches mounted in a housing and an actuator which may be actuated by the operator's thumb from the outside of the housing, to activate one of the two switches as selected, and to leave the other in a rest condition, wherein guiding means guide the actuator in relation to the housing, on the one hand along a lateral direction between two active positions, and on the other hand along a direction of depression in each active position, against resilient restoring means, the actuator being connected to pressure means positioned so as to be in each active position of the actuator, opposite an actuating member of one of the switches which can then be actuated by depressing the actuator, and offset with respect to an actuating member of the other switch, and wherein for its movement in said lateral direction, the actuator is pivotally guided about an axis essentially parallel to the direction of depression.

33. A control box adapted to be suspended from a vertical cable and provided with a bottom handle, said control box being adapted to control an electric motor operable in two directions, comprising two switches mounted in a housing and an actuator which may be actuated by the operator's thumb from the outside of the housing, to activate one of the two switches as selected, and to leave the other in a rest condition, wherein guiding means guide the actuator in relation to the housing, on the one hand along a lateral direction between two active positions, and on the other hand along a direction of depression in each active position, against resilient restoring means, the actuator being connected to pressure means positioned so as to be in each active position of the actuator, opposite an actuating member of one of the switches which can then be actuated by depressing the actuator, and offset with respect to an actuating member of the other switch, and wherein for its movement in said lateral direction the actuator is guided in translation in that direction by being held captive, with the possibility of a predetermined stroke, between formations belonging, on one side of the actuator, to a first half shell of the housing and on the other side of the actuator to a second half shell of the housing.

34. A control box as set forth in claim 33 wherein, when depressed, the actuator is pivotally guided about an axis transverse to the direction of depression.

35. A control box as set forth in claim 34, wherein, for its movement in said lateral direction, the actuator is slidingly guided between said formations in the vicinity of said transverse axis.

36. A control box adapted to be suspended from a vertical cable and provided with a bottom handle, said control box being adapted to control an electric motor operable in two directions, comprising two switches mounted in a housing and an actuator which may be actuated by the operator's thumb from the outside of the housing, to activate one of the two switches as selected, and to leave the other in a rest condition, wherein guiding means guide the actuator in relation to the housing, on the one hand along a lateral direction between two active positions, and on the other hand along a direction of depression in each active position, against resilient restoring means, the actuator being connected to pressure means positioned so as to be in each active position of the actuator, opposite an actuating member of one of the switches which can then be actuated by depressing the actuator, and offset with respect to an actuating member of the other switch, and wherein the actuator is held in relation to the housing via sliding guides permitting, by sliding, movement in the lateral direction and by pivoting the movement of depression.

37. A control box adapted to be suspended from a vertical cable and provided with a bottom handle, said control box being adapted to control an electric motor operable in two directions, comprising two switches mounted in a housing and an actuator which may be actuated by the operator's thumb from the outside of the housing, to activate one of the two switches as selected, and to leave the other in a rest condition, wherein guiding means guide the actuator in relation to the housing, on the one hand along a lateral direction between two active positions, and on the other hand along a direction of depression in each active position, against resilient restoring means, the actuator being connected to pressure means positioned so as to be in each active position of the actuator, opposite an actuating member of one of the switches which can then be actuated by depressing the actuator, and offset with respect to an actuating member of the other switch, and wherein remote from one end accessible to the user's thumb, the actuator is bifurcated into two arms the ends of which are connected to the guiding means.

38. A control box as set forth in claim 37, wherein the arms are connected by flexible means to a hooking device mounted between them and, in service, stationary with the housing.

39. A control box as set forth in claim 37, wherein an auxiliary device is fixed in a wall of the housing in such a way as to occupy a space between the arms inside the housing.

* * * * *